US010349768B1

(12) United States Patent
Jackson

(10) Patent No.: US 10,349,768 B1
(45) Date of Patent: Jul. 16, 2019

(54) MULTI-CONTAINER VESSEL

(71) Applicant: Trenise Z Jackson, Detroit, MI (US)

(72) Inventor: Trenise Z Jackson, Detroit, MI (US)

( * ) Notice: Subject to any disclaimer, the term of this patent is extended or adjusted under 35 U.S.C. 154(b) by 36 days.

(21) Appl. No.: 15/653,775

(22) Filed: Jul. 19, 2017

(51) Int. Cl.

| | |
|---|---|
| ***A47G 21/18*** | (2006.01) |
| ***B65D 77/28*** | (2006.01) |
| ***B65D 25/04*** | (2006.01) |
| *A45C 11/00* | (2006.01) |
| *A47G 21/00* | (2006.01) |

(52) U.S. Cl.
CPC ..... *A47G 21/18* (2013.01); *B65D 25/04* (2013.01); *B65D 77/28* (2013.01); *A45C 11/00* (2013.01); *A47G 21/00* (2013.01); *B65D 2231/022* (2013.01)

(58) Field of Classification Search
CPC ..... A47G 21/18; A47G 21/00; B65D 25/04; B65D 77/28; B65D 2231/022; A45C 11/00
USPC ... 220/703, 705, 23.83, 23.86, 23.87, 23.88, 220/23.89, 495.01–495.11; 222/251
See application file for complete search history.

(56) References Cited

U.S. PATENT DOCUMENTS

| | | | | |
|---|---|---|---|---|
| 2,392,479 | A * | 1/1946 | Humbert | B65D 77/283 222/464.5 |
| 2,838,220 | A * | 6/1958 | Oppenheimer | B65D 77/283 229/103.1 |
| 3,406,868 | A | 10/1968 | Rogers | |
| 3,486,679 | A * | 12/1969 | Pfahler | B65D 77/283 215/389 |
| 4,251,019 | A * | 2/1981 | Cone | B65D 77/283 215/389 |
| 4,450,966 | A * | 5/1984 | Villavicencio, Jr. | C02F 1/002 138/119 |
| 5,507,156 | A * | 4/1996 | Redmon | A47G 19/2266 220/705 |
| 6,056,149 | A * | 5/2000 | Murphy | B65D 77/283 220/705 |
| 6,076,729 | A * | 6/2000 | Cornell | B65D 5/067 220/706 |
| 7,165,697 | B1 | 1/2007 | Checkalski | |
| 8,272,529 | B2 | 9/2012 | Mansfield | |
| 8,733,578 | B2 | 5/2014 | Michaels | |
| D722,827 | S | 2/2015 | Dirks | |
| 2014/0326731 | A1 | 11/2014 | Raymus | |

FOREIGN PATENT DOCUMENTS

| | | |
|---|---|---|
| WO | 2004075699 | 9/2004 |

* cited by examiner

*Primary Examiner* — Kareen K Thomas
(74) *Attorney, Agent, or Firm* — University of Detroit Mercy International Property Law Clinic

(57) ABSTRACT

A vessel including a first container having a bottom portion, a sidewall, and a first cavity access portion, wherein one of the at least one sidewalls includes a first region and a second region opposed to the first region, wherein the second region of the sidewall is contiguously joined to the bottom portion to define at least in part a first cavity, and wherein the first region includes a first cavity access opening that is configured to engage the first cavity access portion; and a second container having a bottom portion, a sidewall, and a second cavity access portion, wherein one of the at least one sidewall includes a first region and a second region opposed to the first region; wherein the first cavity is larger than the second container such that the second container may be completely contained within the first cavity.

14 Claims, 6 Drawing Sheets

MULTI-CONTAINER VESSEL

TECHNICAL FIELD

The disclosure relates to vessels comprising two or more containers.

BACKGROUND

Vessels have been used to transport various substances that range in physical states including gasses, liquids, and solids. Certain vessels may be designed for particular uses, such as those designed for retaining a liquid food item within a cavity of the vessel (e.g., a drinking glass). Vessels may include an opening such that the contents of the vessel may be accessed. In some cases, the vessel may include an access portion at the opening that is movable such that a user may move the access portion, thereby enabling the user to access the contents of the vessel via the opening (e.g., a lid on a drinking glass or container). The access portion may retain the contents of the vessel when in a closed state (e.g., the lid is attached) and may allow access of the contents of the vessel when in an open state (e.g., the lid is removed). In some scenarios, it is desirable to retain two separate substances such that the separate substances do not come into contact with one another.

SUMMARY

According to one embodiment, there is provided a vessel comprising: a first container having a bottom portion, at least one sidewall, and a first cavity access portion, wherein one of the at least one sidewalls includes a first region and a second region opposed to the first region, wherein the second region of the sidewall is contiguously joined to the bottom portion to define at least in part a first cavity, and wherein the first region includes a first cavity access opening that is configured to engage the first cavity access portion; and a second container having a bottom portion, at least one sidewall, and a second cavity access portion, wherein one of the at least one sidewall includes a first region and a second region opposed to the first region, wherein the second region is contiguously joined to the bottom portion to define at least in part a second cavity, and wherein the second region includes a second cavity access opening that is configured to engage the second cavity access portion; wherein the cavity of the first container is larger than the second container such that the second container may be completely contained within the first cavity; wherein the first container is fabricated from a first plastic material, wherein the plastic material is at least partially transparent; wherein the second container is fabricated from a second plastic material; and wherein the first cavity access portion is a container top, and wherein the second cavity access portion is a container top, and wherein the first container top and the second container top are both removably connected to its respective container at the respective cavity access portions.

According to another embodiment, there is provided a multi-container drinking vessel comprising: a first container having a planarly configured bottom portion and a sidewall having a first region and a second region opposed to the first region, wherein the second region of the sidewall is contiguously joined to the bottom portion with the first region located distal thereto, the bottom portion and the sidewall defining a first cavity, the first region of the sidewall at least partially defining a first cavity access opening; a second container having a planarly configured bottom portion and a sidewall having a first region and a second region opposed to the first region, wherein the second region is contiguously joined to the bottom portion with the first region located distal thereto, the bottom portion and the sidewall defining a second cavity, the first region of the sidewall at least partially defining a second cavity access opening; a first container top, wherein the first container top engages the first cavity access opening of the first container; and a second container top, wherein the second container top engages the second cavity access opening of the second container, wherein the first and second container tops are removably connected to their respective containers; wherein the second container is contained within the first cavity; wherein a volume of the first cavity ($V_{C,1}$) is less than or equal to a total volume of the second container ($V_{T,1}$) plus 3.5 fluid ounces, and wherein a volume of the first cavity ($V_{C,1}$) is greater than or equal to a total volume of the second container ($V_{T,1}$) plus 1.0 fluid ounces; and wherein a volume of the second cavity $V_{C,2}$ is less than or equal to 5.0 fluid ounces and greater than or equal to 1.0 fluid ounces.

According to another embodiment, there is provided a multi-container drinking vessel comprising: a first container fabricated from a first transparent plastic material having a planarly configured bottom portion and a sidewall having a first region and a second region opposed to the first region, wherein the second region of the sidewall is contiguously joined to the bottom portion with the first region located distal thereto, the bottom portion and the sidewall defining a first cavity; a second container fabricated from a second transparent plastic material having a planarly configured bottom portion and a sidewall having a first region and a second region opposed to the first region, wherein the second region is contiguously joined to the bottom portion with the first region located distal thereto, the bottom portion and the sidewall defining a second cavity and an outer surface area; wherein the first container defines a first cavity volume ($V_{C,1}$) for holding a first liquid and the second container; wherein the second container defines a second cavity volume ($V_{C,2}$) for holding a second liquid or food item, and wherein the second cavity volume is smaller than the first cavity volume; a first container top, wherein the first container top engages the first region of the sidewall of the first container; and a second container top, wherein the second container top engages the second region of the sidewall of the second container; wherein the first and second container tops are removably connected to each respective container and are selectively resealable relative to each respective container such that the second container top seals the second liquid or food item within the second cavity volume of the second container preventing intermixing with the first liquid in the first cavity volume; wherein the first container top has a straw receiving region defined therein; wherein the first transparent plastic material and the second transparent plastic material are any of the following plastics: polyethylene terephthalate (i.e., PET or PETE), high-density polyethylene (HDPE), low-density polyethylene (LDPE), or polypropylene (PP); wherein the first transparent plastic material is different in color from the second transparent plastic material, and wherein the second transparent plastic material includes a color tint; and wherein the first cavity volume ($V_{C,1}$) is less than or equal to a total volume of the second container ($V_{T,1}$) plus 3.5 fluid ounces, and wherein the first cavity volume ($V_{C,1}$) is greater than or equal to the total volume of the second container ($V_{T,1}$) plus 1.0 fluid ounces.

BRIEF DESCRIPTION OF THE DRAWINGS

Exemplary embodiments will hereinafter be described in conjunction with reference to the appended drawings, wherein like designations denote like elements, and wherein.

DETAILED DESCRIPTION

A multi-container vessel is provided according to the embodiments disclosed herein. Generally, the multi-container vessel includes a first container and a second container, wherein the first and second container include a first and second cavity, respectively, that may be used for retaining a substance. The cavity of the first container can be larger than the second container such that the second container may be completely contained within the first cavity. By providing the second container within the first container, the multi-container vessel can retain two or more substances separately while enabling transport of the two substances as a single unit. In one exemplary embodiment, the first container may be designed to carry an intoxicating beverage (e.g., liquor) and the second container may be designed to retain a chaser (e.g., soda, pickles, limes). In such an embodiment, the multi-container vessel provides a user the ability to ingest the intoxicating drink first and then ingest the chaser thereafter such that the chaser dilutes any potential negative gustatory perceptions that may be experienced due to the intoxicating beverage.

Additionally, as will be described in more detail below, the multi-container vessel may include one or more walls or portions that may be at least semi-transparent. In one embodiment, the first container may be fabricated from a semi-transparent yellow plastic (i.e., the first container includes a color tint of yellow) and the second container may be fabricated from a semi-transparent blue plastic (i.e., the first container includes a color tint of blue). The semi-transparency of the containers can provide a desirable aesthetic visual effect. Moreover, the substances retained in the containers may be semi-transparent and/or various colors, which may add to the desirable aesthetic visual effect.

Figure 1:
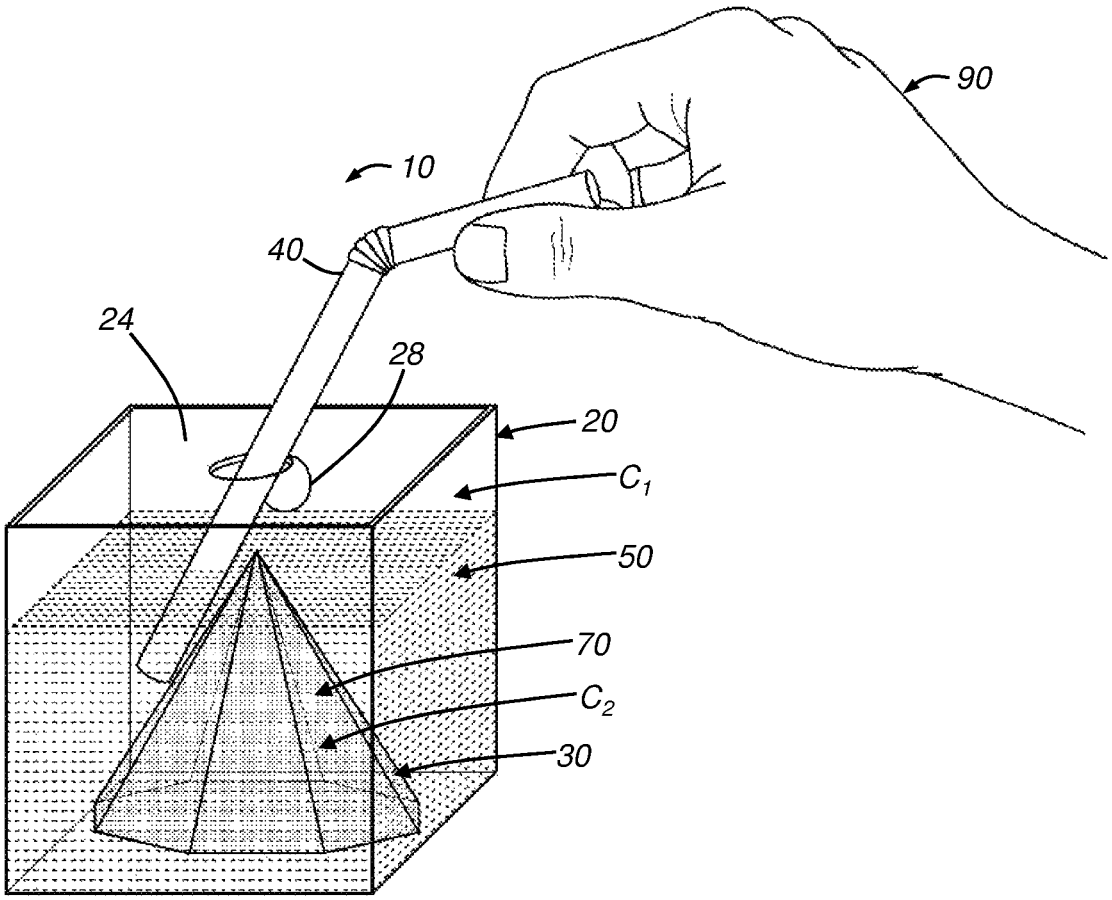
FIG. 1 is a perspective view depicting an embodiment of a multi-container vessel including a drinking straw that is being operated by a user.

With reference to FIG. 1, there is shown an embodiment of a multi-container vessel 10, including a first container 20 and a second container 30. In the particular embodiment illustrated in FIG. 1, the multi-container vessel 10 may additionally comprise a straw 40. The embodiment of FIG. 1 represents a possible scenario of a user 90 enjoying ingestion of substance 50 using straw 40. In the depicted embodiment, the first container 20 is cube-shaped and the second container 30 is pyramidal-shaped with a base that includes eight edges. The first container 20 includes a removable straw receiving portion 28 that is shown as being depressed into the cavity $C_1$ of container 20 such that an opening is created to permit the insertion of straw 40. The removable straw receiving portion 28 may comprise any straw receiving portions known in the art, including a metal foil that can be punctured inward by straw 40, other material that can be punctured, a cap that is press-fitted into the opening, or any other mechanism that can permit an opening for straw 40. In the illustrated embodiment, the first container 20 is depicted as retaining a first substance 50 that is shown to only take up a part of the entire cavity $C_1$ of the first container. The second container 30 is shown as retaining a second substance 60 in a second cavity $C_2$. As seen in FIG. 1, a user 90, may insert the straw 40 through the opening into the cavity $C_1$ and may use the straw 40 to orally ingest substance 50.

Figure 2:
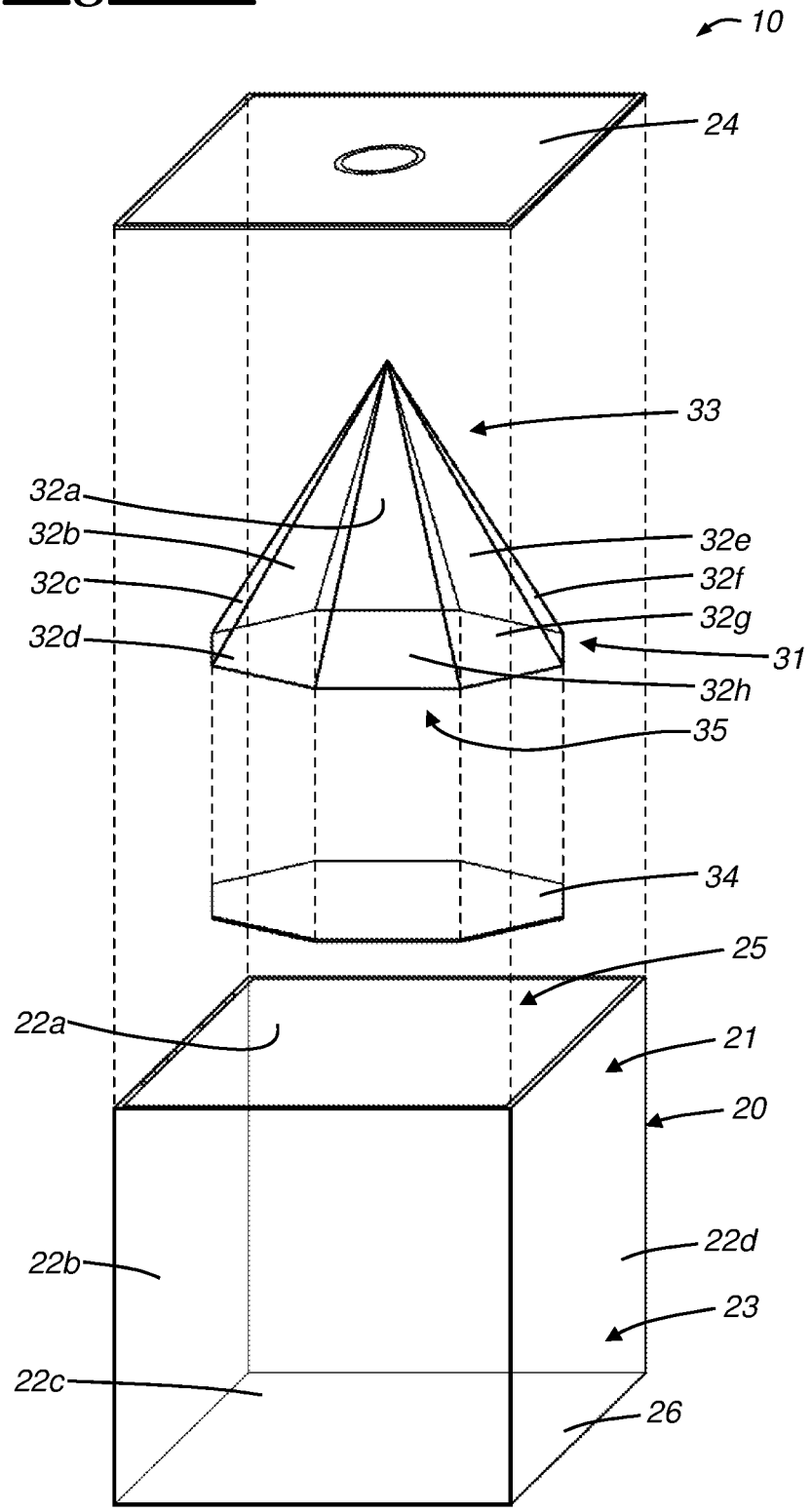
FIG. 2 is an exploded view of an embodiment of a multi-container vessel including a first container and a second container, each of which have a removable cavity access portion.

With reference to FIG. 2, there is shown an exploded view of a particular embodiment of the multi-container vessel 10. The vessel 10 includes a first container 20 having a first cavity access portion 24 and a second container 30 having a second cavity access portion 34. Container 20 is shown to include a cavity defining portion having four sidewalls (22*a*, 22*b*, 22*c*, 22*d*) and a bottom portion 26. As used herein, "sidewall 22" can be interpreted as referring to any of the sidewalls 22*a*, 22*b*, 22*c*, or 22*d*. The sidewalls shown are back wall 22*a*, left wall 22*b*, front wall 22*c*, and right wall 22*d*. Each of the sidewalls 22 include a first region 21 and a second region 23 that is opposed to the first region 21, wherein the second region 23 is contiguously joined to the bottom portion 26 to define the first cavity $C_1$. In some embodiments, the second region 23 is contiguously joined to the bottom portion 26 with the first region 21 located distal thereto. In the depicted embodiment of FIG. 2, the first region 21 may be a top-most region of each sidewall 22 and the second region 23 may be a bottom-most region of each sidewall 22. As depicted, sidewalls 22 are each connected on one edge to an edge of the bottom portion 26 to form a first cavity $C_1$ with a volume $V_{C,1}$. The top edges of the sidewalls 22 of container 20 form a first cavity access opening 25 that is configured to engage a first cavity access portion 24.

The second container 30 of the embodiment illustrated in FIG. 2 is shown to include a cavity defining portion having eight sidewalls (32*a*, 32*b*, 32*c*, 32*d*, 32*e*, 32*f*, 32*g*, 32*h*) and a cavity access portion 34 that can be removed to form a second cavity access opening 35. As used herein, "sidewall 32" can be interpreted as referring to any of the sidewalls 32*a*, 32*b*, 32*c*, 32*d*, 32*e*, 32*f*, 32*g*, or 32*h*. The walls 32 shown are back wall 32*a*, back-left wall 32*b*, left wall 32*c*, front-left wall 32*d*, back-right wall 32*e*, right wall 32*f*, front-right wall 32*g*, and front wall 32*h*. Similar to container 20, each of the sidewalls 32 include a first region 31 and a second region 33 that is opposed to the first region 31, wherein the second region 33 is contiguously joined to the bottom portion 36 to define a second cavity $C_2$. In some embodiments, the second region 33 is contiguously joined to the bottom portion 36 with the first region 31 located distal thereto. The second container 30 of this particular disclosed embodiment is pyramidal-shaped and includes an apex 37, and the bottom portion 36 of the second container 30 includes the apex 37. In the depicted embodiment of FIG. 2, the first region 31 may be a region opposed from the cavity access opening 35 of each sidewall 32 and the second region 33 may be a region adjacent to the cavity access opening 35 of each sidewall 32. As depicted, sidewalls 32 are each connected on one edge to an edge of the base member 36 to form a second cavity with a volume $V_{C,2}$. The top edges of the sidewalls 32 of container 30 form the second cavity access opening 35 that is configured to engage a second cavity access portion 34.

The total volume $V_{T,2}$ of the container 30, which includes the volume $V_{C,2}$ of the second cavity $C_2$ and the walls 32 and access portion 34, is smaller than the volume $V_{C,1}$ of the first cavity $C_1$ in container 20 such that the second container 30 may be completely contained within the first cavity $C_1$. Moreover, the area $A_1$ of the cavity access opening 25 (the area within the two-dot line in the illustrated embodiment) of first container 20 may be sufficiently large to permit the insertion and removal of container 30 into and out of the first cavity $C_1$. In some embodiments, the volumes of the containers and/or cavities may be sized such that the vessel 10 can retain a specific amount of liquid. For example, intoxicating liquor beverages are commonly ingested in a standard amount, namely a "shot," which, in the United States, is approximately 1.5 fluid ounces. Therefore, vessel 10 may be constructed such that $V_{C,1}-V_{T,2}$ (i.e., the volume $V_{C,1}$ of the first cavity $C_1$ that is left after placing the second container 30 into the first cavity $C_1$) is equal to approximately 1.5 fluid ounces. Those skilled in the art will recognize that other particular volumes may be used instead of 1.5 fluid ounces. For example, the vessel 10 can be constructed such that, when the second container 30 is inside the first cavity $C_1$, the remaining volume of the first cavity $C_1$ (i.e., the volume $V_{C,1}-V_{T,2}$) is greater than or equal to 1.0 fluid ounce and less than or equal to 3.0 fluid ounces. Additionally, the vessel can be constructed such that the volume $V_{C,2}$ of the second cavity $C_2$ is a particular amount, such as 1.0 to 5.0 fluid ounces.

Figure 3:
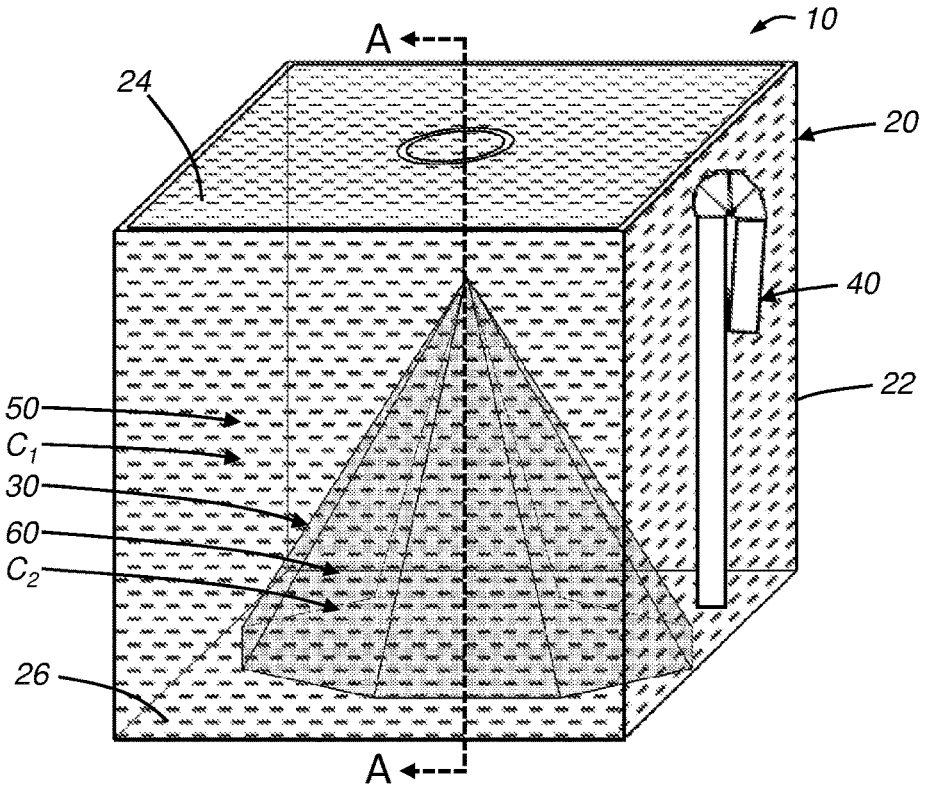
FIG. 3 is a perspective view depicting an embodiment of a multi-container vessel that includes a first container and a second container, each of which contain a liquid substance.
Figure 4:
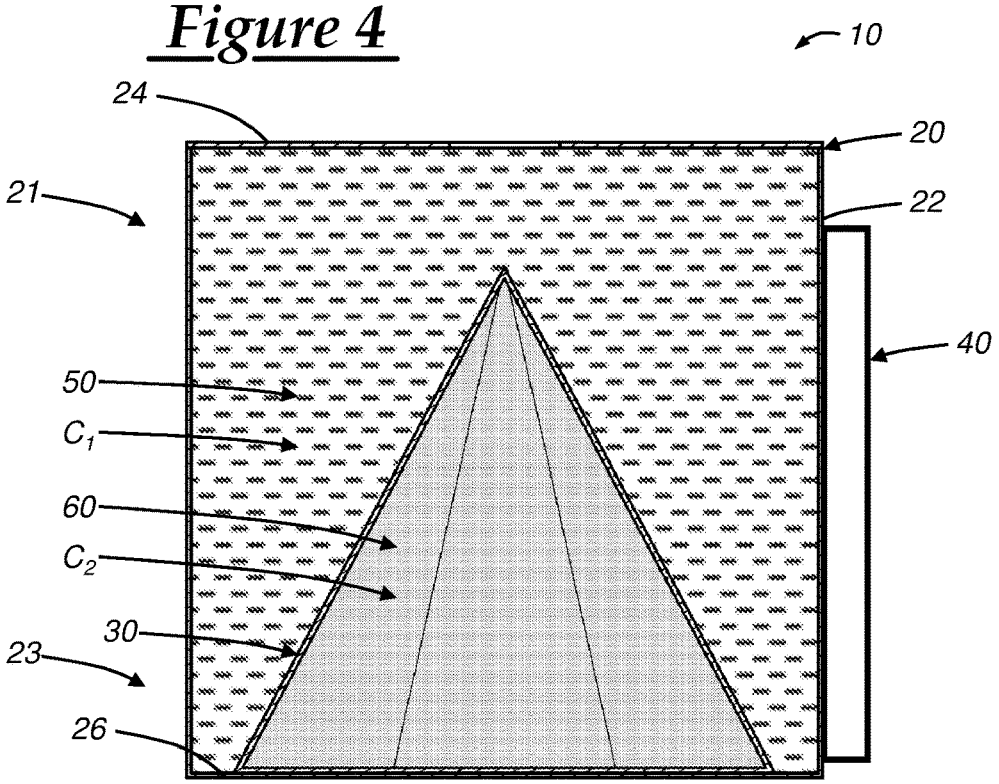
FIG. 4 is a cross-sectional view of the multi-container vessel depicted in FIG. 3.

With reference to FIGS. 3 and 4, there is shown an embodiment of the multi-container vessel 10 where the straw 40 may be attached to a sidewall 22 of the first container 20. As shown in the cross-sectional view of FIG. 3 and discussed in detail below, the vessel 10 can hold two substances 50,60 separate from one another. The substances may be food items, such as drinkable liquids or solid foods. For example, in one scenario, first container 20 may be filled with liquor and second container 30 may be filled with a chaser, such as a cola or soda. In another scenario, the second container can be filled with solid food, such as pickles or limes, which may be desirable when the liquor is tequila.

Also, as shown in FIG. 3 and FIG. 4, container 20 has a planarly configured bottom portion 26 and container 30 has a planarly configured cavity access portion 34. Thus, the cavity access portion may lie flat or rest on the bottom portion 26 of container 20, such that the container 30 rests flatly within the first cavity. In some embodiments, the walls of containers 20 and 30 can be made from a plastic material, such as polyethylene terephthalate (i.e., PET or PETE), high-density polyethylene (HDPE), low-density polyethylene (LDPE), or polypropylene (PP). The plastic material can be transparent, and the substances can be various colors thereby resulting in an aesthetically pleasing visual effect. The plastic material can be transparent with a color tint such that the plastic material is partially transparent and tinted a certain color.

Figure 5:
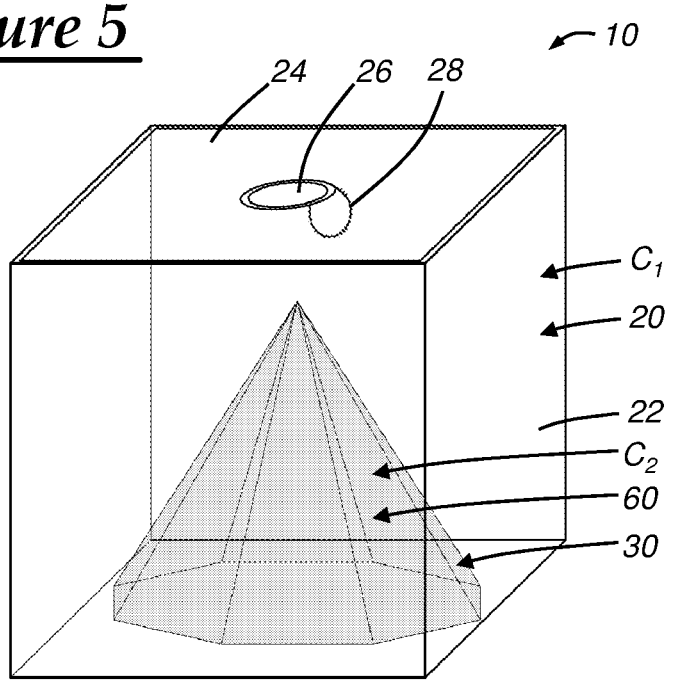
FIG. 5 is a perspective view of the multi-container vessel depicted in FIG. 3 in a scenario where the first container does not contain a liquid substance.
Figure 6:
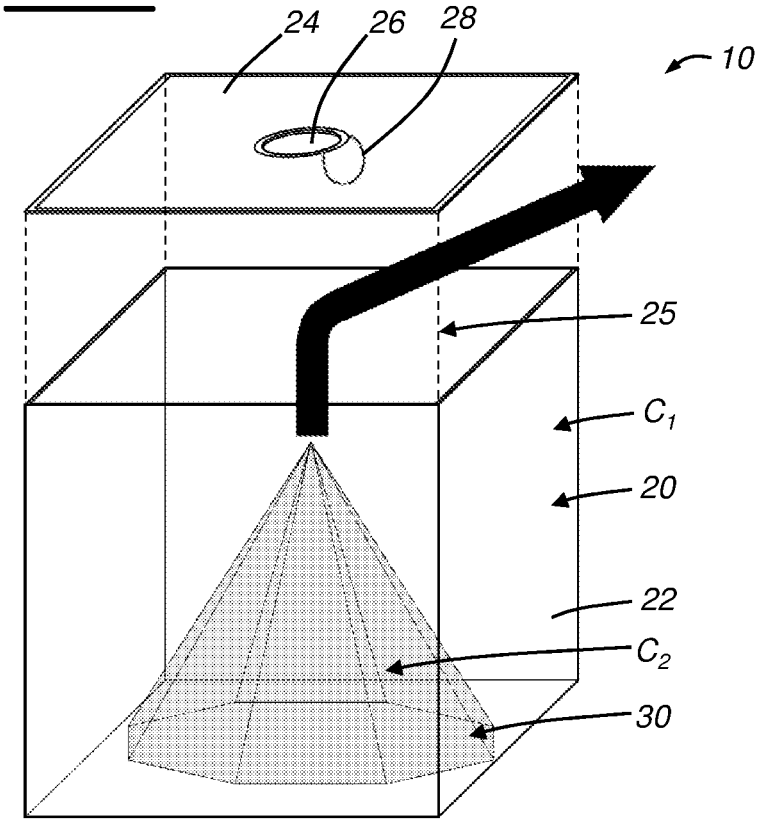
FIG. 6 is a perspective view of the multi-container vessel depicted in FIG. 3 in the scenario presented in FIG. 5 and further in that the first cavity access portion is detached from the first container body.

With reference to FIGS. 5 and 6, there is shown multi-container vessel 10 wherein the first substance 50 (FIG. 1) has been substantially removed from the first cavity $C_1$. For example, as discussed above, user 90 may ingest substance 50 using a straw insertable into a straw receiving portion 28 (FIG. 1). After the user 90 ingests substantially all of substance 50, the first cavity $C_1$ may be substantially empty except for container 30. The user 90 may then desire to access substance 60 that is retained within the second cavity $C_2$ of the second container 30. To do so, the user may remove or operate the first cavity access portion 24 in order to access the second container 30, which contains substance 60. In the illustrated embodiment, the user may remove the cavity access portion 24 in order to open the first container 20 in order to access the first cavity $C_1$, and accordingly, access the second container 30 that is retained within the first cavity $C_1$.

The cavity access portion 24 may be a container top, such as any of a number of removeable container tops or lids that are known in the art. The container top or lid may be resealable onto the container 20. Cavity access portion 24 can be removably connected to container 20 at the cavity access opening 25. The container top or lid 24 may be removably connected to container 20 and is selectively resealable relative to container 20. In the disclosed embodiment of FIGS. 5 and 6, the cavity access portion 24 is a press-fit lid (or snap-fit lid). The press-fit lid can be fabricated from plastics, such as those discussed above, and may be made from the same or different material as the rest of the container 20. In one embodiment, the access portion 24 can be made from a separate material, and may consist of a different color and/or opacity than the rest of the container 20. In another embodiment, the cavity access portion 24 can be made from the same materials as the rest of the container 20. In other embodiments, the cavity access portion 24 may comprise any one of a slideable door, a hinge-type door, an accordion-type door, a pocket door, or a multi-fold door. Once the cavity access portion 24 is removed, the user may then remove the second container 30 through the first cavity access opening 25 and from the first cavity $C_1$, as illustrated in FIG. 6.

Figure 7:
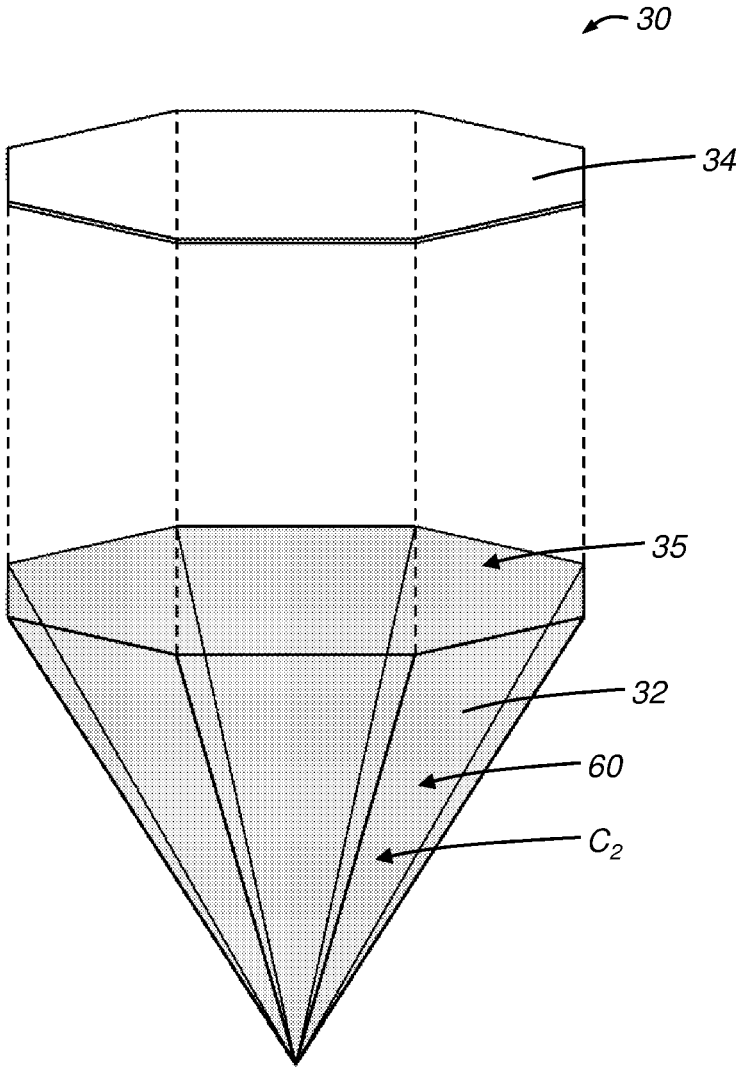
FIG. 7 is a perspective view of the second container of the multi-container vessel depicted in FIG. 3 that includes the second cavity access portion detached from the second container body.

With reference to FIG. 7, the second container 30 of the particular embodiment of the multi-container vessel 10 is illustrated. As discussed above, once a user removes container 30 from the first cavity $C_1$ of first container 20, a user may desire to access the contents 60 of the second cavity $C_2$, which may include a chaser, other liquid, or a solid food item. In one embodiment, the volume of the second cavity $V_{C,2}$ is less than or equal to 5.0 fluid ounces and greater than or equal to 1.0 fluid ounces. Cavity access portion 34 can be removably connected to container 30 at the cavity access opening 35. The cavity access portion 34 may comprise any of a number of removeable container tops or lids that are known in the art. The container top or lid 34 may be removably connected to container 30 and is selectively resealable relative to container 30 such that the second container top 34 seals the second liquid or food item 60 within the second cavity $C_2$ of the second container 30 preventing intermixing with the first liquid 50 in the first cavity $C_1$. In the disclosed embodiment of FIGS. 5 and 6, the cavity access portion 34 is a press-fit lid (or snap-fit lid). The press-fit lid can be removed from container 30 to permit access to the second cavity $C_2$. The press-fit lid can be fabricated from plastics, such as those discussed above, and may be made from the same or different material as the rest of the container 30. In one embodiment, the access portion 34 can be made from a separate material, and may consist of a different color and/or opacity than the rest of the container 30. In another embodiment, the cavity access portion 34 can be made from the same materials as the rest of the container 30. The second cavity access portion 34 may be removed by a user thereby allowing access to substance 60 via the second cavity access opening 35. In other embodiments, the cavity access portion 34 may be a slideable door, a hinge-type door, an accordion-type door, a pocket door, or a multi-fold door.

Figure 8:
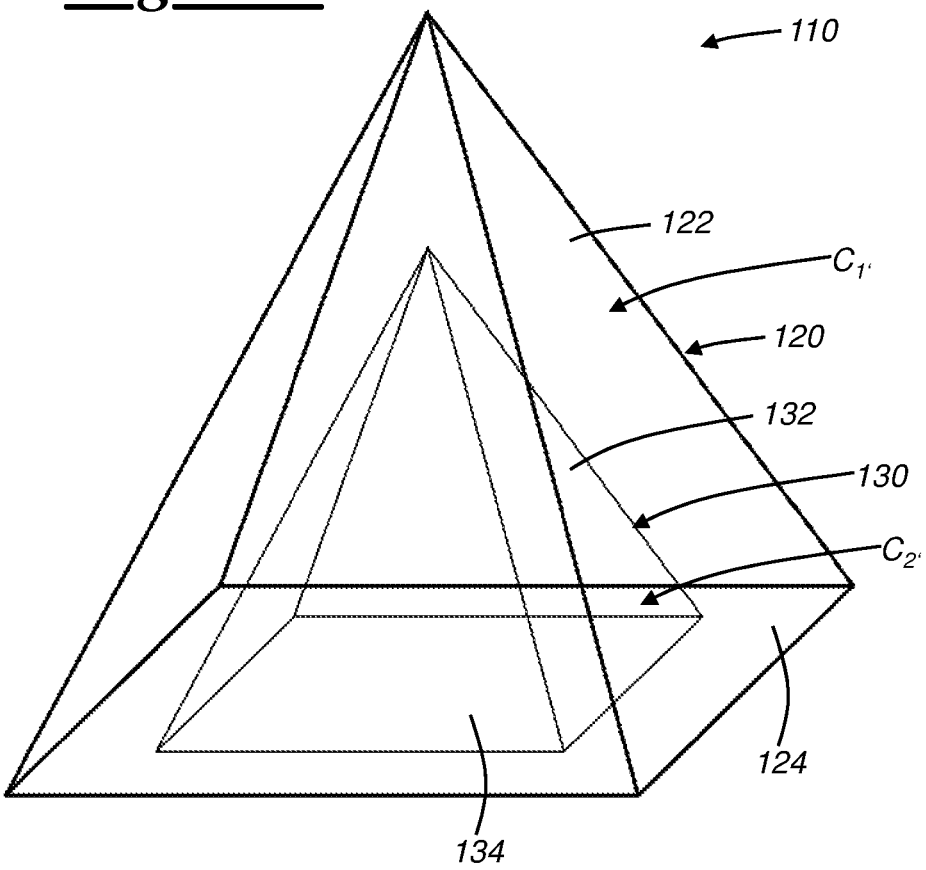
FIG. 8 is a perspective view of another embodiment of a multi-container vessel.

With reference to FIG. 8, there is shown another embodiment of a multi-container vessel 110. In this embodiment, both the first container 120 and the second container 130 are pyramidal-shaped. First container 120 includes a cavity defining portion having four sidewalls 122 and a cavity access portion 124. A first cavity $C_{1'}$ is defined by four sidewalls 122 such that a substance may be retained within the container. The cavity access portion 124 may be attached to a second region 123 of the sidewalls, while a first region 121 of the sidewalls may all converge at an apex of the pyramidal-shaped container. Cavity access portion 124 may be removed from the sidewalls thereby permitting access of the contents of the first cavity $C_{1'}$, which can include a substance, such as a liquor, and the second container 130.

Second container 130 is similar in shape to the first container 120, but is smaller is size. The second container includes a cavity defining portion that defines a second cavity $C_{2'}$, and which includes four sidewalls 132 and a cavity access portion 134. The cavity access portion 134 may be removed to permit access to the contents of the second cavity $C_{2'}$. In regards to both container 120 and container 130, the walls or members defining the cavity defining portions are all situated in a like arrangement such that no wall or member in particular defines a bottom portion of the container. Thus, in such an embodiment where the container is pyramidal-shaped, the bottom portion may comprise of an apex of the container. For example, in the illustrated embodiment of FIG. 8, the bottom portion 126 of the first container 120 comprises the apex 127 and the bottom portion 136 of the second container 130 comprises the apex 137.

Figure 9:
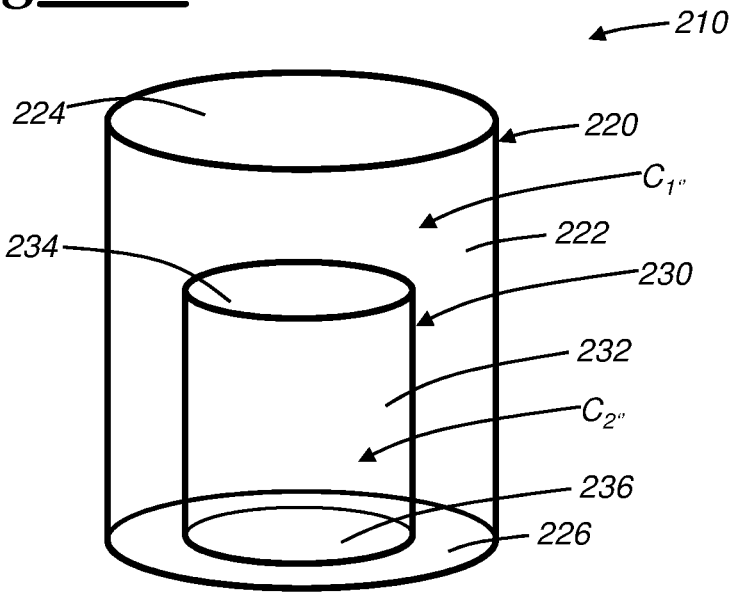
FIG. 9 is a perspective view of yet another embodiment of a multi-container vessel.

With reference to FIG. 9, there is shown yet another embodiment of a multi-container vessel 210. In this embodiment, both the first container 220 and the second container 230 are cylindrical-shaped. First container 220 includes a cavity defining portion having one sidewall 222 and a cavity access portion 224. A first cavity $C_{1''}$ is defined by the sidewall 222 and bottom portion 226 such that a substance may be retained within the container. The cavity access portion 224 may be attached to a second region 223 of the sidewall 222, while a first region 221 of the sidewall 222 may be attached to bottom portion 226. Cavity access portion 224 may be removed from the sidewall thereby permitting access of the contents of the first cavity $C_{1''}$, which can include a substance, such as a liquor, and the second container 230.

Second container 230 is similar in shape to the first container 220, but is smaller is size. The second container includes a cavity defining portion that defines a second cavity $C_{2''}$, and a cavity access portion 234. The cavity defining portion of the second container 230 includes a sidewall 232 and a bottom portion 236. The cavity access portion 234 may be removed to permit access to the contents of the second cavity $C_{2''}$.

In other embodiments, more than two containers may be used and the containers may be constructed of various shapes and sizes. For example, a container in the shape of a sphere, a cuboid, a cone, a prism (e.g., a hexagonal prism), another type of pyramid, or another type of polyhedron. Additionally, any one or more of the containers may be comprised of a plastic material, a polymer material, a glass material, or a metal material, including metal alloys (e.g., stainless steel, aluminum alloys). The materials may be constructed such that they are at least partially transparent and may be died or otherwise colored various colors.

In regards to the specification and the claims, the terms "e.g.," "for example," "for instance," "such as," "like," "comprising," "having," "including," and their other forms, are to be construed as open-ended, such that additional components or elements are not necessarily excluded. The terms herein shall be interpreted using the broadest reasonable interpretation under the context in which the terms are used. In addition, the term "and/or" is to be construed as an inclusive or. As an example, the phrase "A, B, and/or C" includes: "A"; "B"; "C"; "A and B"; "A and C"; "B and C"; and "A, B, and C."

The invention claimed is:

1. A vessel comprising:

a first container having a bottom portion, at least one sidewall, and a first cavity access portion, wherein one of the at least one sidewalls includes a first region and a second region opposed to the first region, wherein the second region of the sidewall is contiguously joined to the bottom portion to define at least in part a first cavity, and wherein the first region includes a first cavity access opening that is configured to engage the first cavity access portion; and a second container having a bottom portion, at least one sidewall, and a second cavity access portion, wherein one of the at least one sidewall includes a first region and a second region opposed to the first region, wherein the second region is contiguously joined to the bottom portion to define at least in part a second cavity, and wherein the second region includes a second cavity access opening that is configured to engage the second cavity access portion;

wherein the first cavity is larger than the second container such that the second container may be completely contained within the first cavity;

wherein the first container is fabricated from a first plastic material, wherein the plastic material is at least partially transparent;

wherein the first cavity access portion is a container top, and wherein the second cavity access portion is a container top, and wherein the first container top and the second container top are both removably connected to its respective container at the respective cavity access portions.

2. The vessel of claim 1, wherein the second container is at least partially transparent.

3. The vessel of claim 1, wherein a volume of the first cavity ($V_{C,1}$) is less than or equal to a total volume of the second container ($V_{T,2}$) plus 3.5 fluid ounces, and wherein the volume of the first cavity ($V_{C,1}$) is greater than or equal to a total volume of the second container ($V_{T,2}$) plus 1.0 fluid ounces.

4. The vessel of claim 1, wherein the first container is configured to retain a first liquid and the second container is configured to retain a second liquid or other food item.

5. The vessel of claim 1, wherein the bottom portion of the second container is configured to rest on the bottom portion of the first container.

6. The vessel of claim 1, wherein the first plastic material is one or more of the following plastic materials: polyethylene terephthalate (PET or PETE), high-density polyethylene (HDPE), low-density polyethylene (LDPE), or polypropylene (PP).

7. The vessel of claim 6, wherein the second plastic material is the same as the first plastic material.

8. The vessel of claim 1, wherein the second container is pyramidal-shaped and includes an apex, and wherein the bottom portion of the second container includes a region including the apex.

9. The vessel of claim 8, wherein at least one of the first container top or the second container top is resealable relative to its respective container.

10. The vessel of claim 9, wherein the first container top has a straw receiving region defined therein.

11. The vessel of claim 3, wherein the first container has a first geometric cross section and the second container has a geometric cross section that differs from the first geometric cross section.

12. The vessel of claim 1, wherein a volume of the first cavity ($V_{C,1}$) is greater than a total volume of the second container ($V_{T,2}$) by at least 1.0 fluid ounce.

13. A vessel comprising:

a first container having a planarly configured bottom portion and a sidewall having a first region and a second region opposed to the first region, wherein the second region of the sidewall is contiguously joined to the bottom portion with the first region located distal thereto, the bottom portion and the sidewall defining a first cavity, the first region of the sidewall at least partially defining a first cavity access opening;

a second container having a planarly configured bottom portion and a sidewall having a first region and a second region opposed to the first region, wherein the second region is contiguously joined to the bottom portion with the first region located distal thereto, the bottom portion and the sidewall defining a second cavity, the first region of the sidewall at least partially defining a second cavity access opening;

a first container top, wherein the first container top engages the first cavity access opening of the first container; and wherein a volume of the first cavity ($V_{C,1}$) is less than or equal to a total volume of the second container ($V_{T,2}$) plus 3.5 fluid ounces, and wherein a volume of the first cavity ($V_{C,1}$) is greater than or equal to a total volume of the second container ($V_{T,2}$) plus 1.0 fluid ounces; and wherein a volume of the second cavity $V_{C,2}$ is less than or equal to 5.0 fluid ounces and greater than or equal to 1.0 fluid ounces.

14. A dual container drinking vessel comprising:

a first container fabricated from a first transparent plastic material having a planarly configured bottom portion and a sidewall having a first region and a second region opposed to the first region, wherein the second region of the sidewall is contiguously joined to the bottom portion with the first region located distal thereto, the bottom portion and the sidewall defining a first cavity;

a second container fabricated from a second transparent plastic material having a planarly configured bottom portion and a sidewall having a first region and a second region opposed to the first region, wherein the second region is contiguously joined to the bottom portion with the first region located distal thereto, the bottom portion and the sidewall defining a second cavity and an outer surface area;

wherein the first container defines a first cavity volume ($V_{C,1}$) for holding a first liquid and the second container;

wherein the second container defines a second cavity volume ($V_{C,2}$) for holding a second liquid or food item, and wherein the second cavity volume is smaller than the first cavity volume;

a first container top, wherein the first container top engages the first region of the sidewall of the first container; and a second container top, wherein the second container top engages the second region of the sidewall of the second container;

wherein the first and second container tops are removably connected to each respective container and are selectively resealable relative to each respective container such that the second container top seals the second liquid or food item within the second cavity volume of the second container preventing intermixing with the first liquid in the first cavity volume;

wherein the first container top has a straw receiving region defined therein;

wherein the first transparent plastic material and the second transparent plastic material are any of the following plastics: polyethylene terephthalate (PET or PETE), high-density polyethylene (HDPE), low-density polyethylene (LDPE), or polypropylene (PP);

wherein the first transparent plastic material is different in color from the second transparent plastic material, and wherein the second transparent plastic material includes a color tint; and wherein the first cavity volume ($V_{C,1}$) is less than or equal to a total volume of the second container ($V_{T,2}$) plus 3.5 fluid ounces, and wherein the first cavity volume ($V_{C,1}$) is greater than or equal to the total volume of the second container ($V_{T,2}$) plus 1.0 fluid ounces.

* * * * *